United States Patent [19]

Wiedemann

[11] Patent Number: 4,472,491

[45] Date of Patent: Sep. 18, 1984

[54] ELECTROPHOTOGRAPHIC RECORDING MATERIAL HAVING PROTECTIVE LAYER AND PROCESS FOR THE PRODUCTION THEREOF

[75] Inventor: Wolfgang Wiedemann, Geisenheim, Fed. Rep. of Germany

[73] Assignee: Hoechst Aktiengesellschaft, Frankfurt am Main, Fed. Rep. of Germany

[21] Appl. No.: 382,287

[22] Filed: May 26, 1982

[30] Foreign Application Priority Data

May 30, 1981 [DE] Fed. Rep. of Germany ..... 3121563

[51] Int. Cl.[3] ..... G03G 8/00

[52] U.S. Cl. ..... 430/58; 430/67; 430/132; 430/961; 430/900

[58] Field of Search ..... 430/67, 132, 58, 961

[56] References Cited

U.S. PATENT DOCUMENTS 2,297,691 10/1942 Carlson ..... 430/31
4,220,697 9/1980 Wiedemann ..... 430/59
4,225,648 9/1980 Hasegawa et al. ..... 428/336
4,251,612 2/1981 Chu ..... 430/67 X

FOREIGN PATENT DOCUMENTS 01632 1/1979 Japan ..... 430/67

*Primary Examiner*—John D. Welsh
*Attorney, Agent, or Firm*—Schwartz, Jeffery, Schwaab, Mack, Blumenthal & Koch

[57] ABSTRACT

An electrophotographic recording material comprised of an electrically conductive support, an optional insulating interlayer, a photoconductive system comprised of at least one layer of organic material containing a charge carrier-producing compound and a charge-transporting compound, and a radiation-cured, transparent protective layer, wherein the protective layer has been applied onto the surface of the photoconductive system with the aid of a removable auxiliary support and is comprised of an acrylated binder which is cured by irradiation with ultraviolet light. Also disclosed is a process for the production of the recording material.

11 Claims, 6 Drawing Figures

ELECTROPHOTOGRAPHIC RECORDING MATERIAL HAVING PROTECTIVE LAYER AND PROCESS FOR THE PRODUCTION THEREOF

BACKGROUND OF THE INVENTION

The present invention relates to an electrophotographic recording material composed of an electrically conductive support, optionally an insulating interlayer, a photoconductive system composed of at least one layer of organic materials containing a charge carrier-producing compound and a charge-transporting compound, and a radiation-cured transparent protective layer. The invention also relates to a process for the production of the recording material.

In the electrophotographic process for the production of copies, which has been disclosed in U.S. Pat. No. 2,297,691 and is extensively used today, thorough cleaning of the photoconductive layer is always necessary after transfer to the copy carrier of the toner image which has been developed on the photoconductive layer by a dry process. The cleaning is effected as a rule by brushing or wiping the photoconductive layer with brushes or fabrics suitable for this purpose. In copying machines which operate with liquid developers, the action of the mechanical cleaning is frequently reinforced by concomitant use of a cleaning fluid. The cleaning operations have a damaging effect on the photoconductive layer. Further damaging effects are caused, for example, by the dry developer and by the developer station (countervoltage), and by the action of the developer liquid during developing by liquids. The photoconductive layer is also exposed to the ionized air produced in the charging station. It is known that the required cleaning processes and the other influences mentioned lead to an adverse effect on, or even mechanical damage to, the photoconductive layer, and thus result in a reduction of its useful life.

Photoconductive layers protected with an additional top layer are known. Among these may be mentioned, for example, electrophotographic recording materials according to German Patent Application No. P 30 32 773.2 (U.S. Pat. No. 4,387,148), which have an electrically conductive support and thereon a photoconductor layer which is based on organic or inorganic substances. On top of these a protective layer of radiation-cured, crosslinked polyester is located. The disadvantage of these recording materials is that they comprise, as the photoconductive layer, for example, less flexible selenium or selenium-containing layers in which a curing action by UV irradiation can even cause an undesired gradual modification change. It is also disadvantageous that photoconductor layers are used which are generally less sensitive photoconductor systems and are adversely affected as regards their photoconductor properties by the top layer applied.

Furthermore, German Patent Application No. P 30 32 774.3 (U.S. Pat. No. 4,390,609) discloses a recording material which possesses a protective layer composed of a binder which is resistant to surface abrasion and is composed of a polyurethane resin, a polycarbonate resin, a phenoxy resin, a polyacrylate or polymethacrylate resin, or the most diverse acrylate or epoxide resins containing hydroxyl groups and polyisocyanate groups. The binders employed do not crosslink, or can be subsequently crosslinked thermally, or are self-crosslinking. The protective layers are applied onto the photoconductor layer by coating or immersion, or even by spraying, which may be electrostatic, with subsequent drying and, if appropriate, curing. For this purpose solvents are required which, on the one hand, readily dissolve the substances to be applied, but do not attack or initially dissolve the substances of the particular photoconductor layer.

However, depending on the choice of solvent, the technique of application and the composition of the layer, it has been found that the photoconductive layer located under the protective layer is initially dissolved to various extents, and its photoconductive properties can be disadvantageously affected thereby.

SUMMARY OF THE INVENTION

It is therefore an object of the present invention to provide an improved electrophotographic recording material.

Another object of the invention is to provide an electrophotographic recording material in which the highly photosensitive photoconductor systems, which are composed of organic materials and are preferably arranged as a double photoconductor layer, are provided with a transparent protective layer which protects them from mechanical or, if necessary, other disadvantageous effects.

It is a particular object to provide such a recording material wherein the protective layer is composed of materials which are transparent to visible light, has no adverse effect or only an insignificant adverse effect, on the function of the photoconductor layer, and makes it possible to increase the useful life.

It is also an object of the present invention to provide a process for the production of such a recording material.

In accomplishing the foregoing objects, there has been provided according to the present invention an electrophotographic recording material comprised of an electrically conductive support, optionally an insulating interlayer, a photoconductive system comprised of at least one layer of organic materials containing a charge carrier-producing compound and a charge-transporting compound, a radiation-cured, transparent protective layer, wherein the protective layer, which has been applied onto the surface of the photoconductive system with the aid of a removable auxiliary support, is comprised of an acrylated binder which has been cured by irradiation with ultraviolet light. The protective layer preferably contains an acrylated polyurethane, an acrylated polyester or an acrylated epoxide resin as the acrylated binder. Acrylated polyurethane is particularly preferred. Furthermore, the protective layer contains a reactive diluent and a photoinitiator, and is from about 0.1 to 10 μm in thickness.

There has also been provided according to the invention a process for producing the recording material comprising the steps of applying a protective layer, which is located on an auxiliary support and is comprised of an acrylated binder, onto the surface of the photoconductive system, curing the protective layer by irradiation with ultraviolet light, and removing the auxiliary support. The application is preferably effected by lamination at a temperature between about 40°–80° C. and under contact pressure, e.g., from rollers. The auxiliary support can be removed immediately after the UV irradiation, or at a later time, for example, not until shortly before the electrophotographic recording material is used.

By this means, it is possible to provide an electrophotographic recording material in which the resistance to abrasion and the useful life are significantly improved, with virtually unchanged photosensitivity. In addition, the formation of surface films, which is caused by developing with liquid or dry toners, can be significantly reduced. Furthermore, as a result of the increase in the resistance to abrasion, and thus in the useful life, it is more economically feasible to employ multilayer arrangements of photoconductive systems not only on flexible conductive supports, but also on drums.

Further objects, features and advantages of the present invention will become apparent from the detailed description of preferred embodiments which follows, when considered in light of the attached figures of drawing.

DETAILED DESCRIPTION OF PREFERRED EMBODIMENTS

Figure 1A:
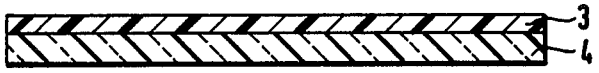
FIG. 1*a* is a cross-sectional view of the protective layer located on its support layer.
Figure 1B:
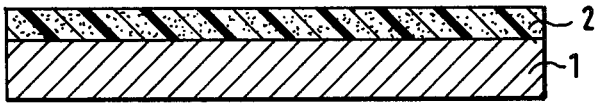
FIG. 1*b* is a cross-sectional view of a photoconductive layer on a support layer.
Figure 2:
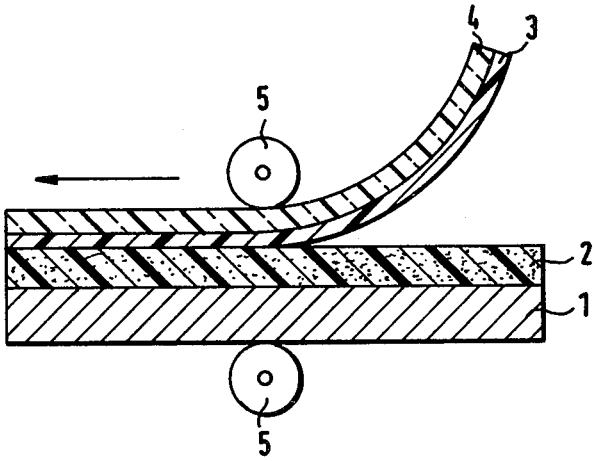
FIG. 2 is a schematic representation of the lamination process of the invention.
Figure 3:
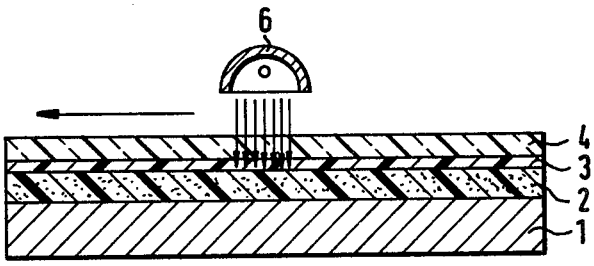
FIG. 3 is a schematic representation of the irradiation step of the process.
Figure 4:
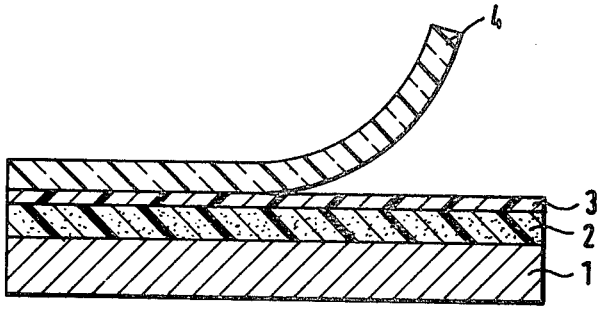
FIG. 4 is a schematic representation of the step of removing the support layer for the protective layer.
Figure 5:
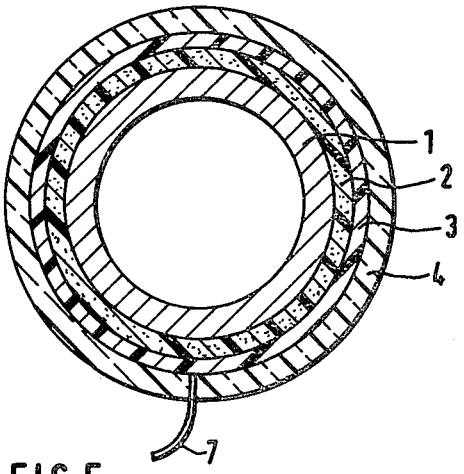
FIG. 5 is a cross-sectional view of a drum produced from the recording material according to the invention.

The recording material according to the invention and the process for the production of this material are represented schematically by the attached FIGS. 1 to 5. Thus, the photoconductive system 2 can be present in principle as a single layer on the support 1, as indicated in FIG. 1*b*. Reference numeral 3 indicates the protective layer according to the invention, which is located on the auxiliary support 4 (FIG. 1*a*). FIG. 2 shows the lamination process which is carried out, for example, between two rollers 5, whereby the protective layer 3 located on the auxiliary support 4 is applied to the electrophotographic recording material 1, 2. FIG. 3 represents the irradiation step with a source of ultraviolet light 6, of the material provided with the protective layer and the auxiliary support. The step of removing the auxiliary support 4 from the recording material produced according to the invention is represented by FIG. 4. FIG. 5 represents an electrophotographic recording material which has been produced according to the invention. It is in the form of a drum and has on its auxiliary support 4 a tab 7 for peeling off the auxiliary support 4.

According to the invention, acrylated polymers, for example, acrylated urethanes, and also acrylated polyesters, epoxides and oligomers based on oil, are suitable as the curable acrylated binder for the protective layer 3, which binder is resistant to surface abrasion and also prevents surface film formation by toner. The favorable reactivity under UV irradiation is accounted for by the acrylate functionality. Acrylated polyurethanes are particularly distinguished by their high resistance to abrasion and chemicals. UV-crosslinkable organic prepolymers, in particular reactive resins based on an acrylated polyurethane (for example the product designated VPS 1748 by Degussa), are also suitable. In addition, prepolymers, for example, acrylated polyesters or epoxides with isocyanates, can be employed as reactive resins.

Owing to their high viscosity, these prepolymers are too viscous for processing. By using solvents, for example, tetrahydrofuran, particularly by using reactive diluents, the viscosity values can be decreased significantly in order to obtain protective layers in the range of thickness of from about 0.1–10 μm, preferably from about 0.1 to 5 μm.

In this context, n- or iso-butyl acrylate, 2-ethylhexyl acrylate, N-vinylpyrrolidone, isodecyl acrylate and phenoxyethyl acrylate are suitable monomers which are favorable for dilution. Formulations containing crosslinking agents, such as butanediol 1,4-diacrylate, hexanediol 1,6-diacrylate or, in particular, trimethylolpropane tri(tetra)-acrylate (TMPTA) or pentaerythritol tri(tetra)-acrylate (PETA), are preferred.

Photoinitiators, such as benzoin ether derivatives, thioxanthones and their derivatives, and also benzophenones, for example, Michler's ketone and acetophenone derivatives, are used for initiating the curing process in ultraviolet light. Benzil dimethyl ketals, 2-hydroxy-2-methyl-1-phenylpropan-1-one and substituted α-halogenoacetophenone have proved particularly advantageous. Tertiary alkanolamines can be used as additives to the UV hardeners. They improve the resistance of the photoinitiators to the action of oxygen.

Because the irradiation with ultraviolet light is effected according to the invention in the presence of the transparent auxiliary support, the admission of oxygen is effectively prevented. In individual cases, it is also possible to carry out the UV irradiation under protective nitrogen gas in order to completely exclude the presence of oxygen.

High pressure mercury vapor lamps, for example, are employed as the radiation source for the curing process by UV irradiation. Those having an electrical output of 100 W/cm of luminous length have proved particularly suitable.

The curable acrylated binders for the protective layer 3, which have been described, are outstandingly suitable owing to their homogeneous film formation and flexibility, their abrasion characteristics, their low extent of toner film formation, and the possibilities of application. The photosensitivity of the recording material is affected only to a small extent.

All films and support materials which are transparent to UV light, in particular films of polyesters, polyethylene or polypropylene, are suitable as the auxiliary support 4. The thickness of the auxiliary support can vary within wide limits, and is not critical. However, it must satisfy the condition that the auxiliary support can be readily removed in one piece, without tearing, as indicated in FIG. 4. Accordingly, thicknesses in the range of about 50 to 100 μm are preferred.

The curing by irradiation with ultraviolet light is effected immediately after the lamination process. The curing can advantageously be combined in a continuous process with the application of the protective layer.

A preferred embodiment comprises applying the protective layer, by coating to a thickness of up to approximately 5 μm, onto an auxiliary support comprised of polyester which is transparent to UV light, and subsequently laminating it onto the photoconductive system, in a laminator, under pressure and while heating to a temperature between about 40°-80° C., preferably to about 50°-60° C., in vacuo. This process can also be effected continuously in an embodiment having the photoconductive system as a double layer in such a manner that the layers of the photoconductive system and the protective layer are each applied, for example, by a flow-on method, and, after drying, the two layers are laminated together under pressure. The curing with ultraviolet light and, if appropriate the peeling off of the auxiliary support can follow continuously. A special use of this method for coating drums is given by the following procedure:

A polyester tubular film as the auxiliary support 4 is coated on the inside with the protective layer 3, this tubular film is shrunk onto the photoconductive drum and is then cured by means of UV irradiation. The tubular auxiliary support film is peeled off immediately afterward or at a later time.

As already described, the protective layer is optically transparent to UV light. The cohesive layer produced on a photoconductive system of organic materials has a uniform thickness from about 0.1-10, preferably from about 0.5-5 μm. The film surface is smooth, which is necessary for optimum cleaning. In addition, the adhesion between the protective layer and the photoconductive system is great enough to withstand mechanical action, for example, by the cleaning brush. The abrasion, as well as the surface film formation, is significantly reduced in comparison with that of a photoconductor system provided with a protective layer by coating.

Of importance is also the fact that the protective layer behaves triboelectrically like the photoconductive system. At a storage temperature of 40°-50° C., the protective layer does not stick, nor is any component exuded from the photoconductive system. The protective layer can also be used for preventing crystallization effects which can arise from contact with the photoconductive surface. The electrical conductivity of the protective layer is such that the charging capacity of the photoconductive system is not affected. On the other hand, the stated materials of the protective layer ensure electrical permeability, so that, on exposure, charges can flow away from the surface, if appropriate, apart from a small residual voltage. The electrostatic charge image is completely retained after exposure until developing of the image, which is necessary so that the resolution of the copy does not decrease. The specific resistivity of the protective layer is not substantially changed by moisture in the environment.

Aluminum foil or optionally transparent polyester film which is laminated or coated by vapor deposition with aluminum is employed, for example, as the electrically conductive support, but any other support which has been rendered sufficiently conductive can be used.

Any of the known arrangements of organic materials which contain charge carrier-producing and charge-transporting compounds in at least one layer are contemplated as a photoconductor system. Those highly photosensitive systems which possess a double layer arrangement and which, owing to their high elasticity, can also be used as photoconductor webs on electrically conductive support films are preferably employed. In particular, very highly photosensitive photoconductor systems, for example, according to German Offenlegungsschrift No. 2,734,288 corresponding to U.S. Pat. No. 4,220,697 (the disclosure of which is hereby incorporated by reference), can be employed as endless webs, owing to their high flexibility, and these webs can be fed over deflection rollers having a relatively small diameter.

Between the electrically conductive support and the photoconductive system, it is possible, furthermore, to provide an optional insulating interlayer. This insulating interlayer can be comprised of a thermally, anodically or chemically produced aluminum oxide interlayer. It can also be comprised of organic materials. Thus, various natural or synthetic resin binders which exhibit good adhesion to a metal or aluminum surface and are only dissolved to a hardly noticeable degree on subsequent application of further layers are used, such as, for example, polyamide resins, polyvinylphosphonic acid, polyurethanes, polyester resins or specifically alkali-soluble binders, such as, for example, styrene/maleic anhydride copolymers. The thickness of such organic interlayers can be up to about 5 μm, and that of the aluminum oxide layer is in most cases in the range of from about 0.01-1 μm.

In addition to the known charge-carrier producing and charge-transporting compounds of the photoconductive system (such as dyes and pigments, or carbocyclic or heterocyclic monomers or polymers, preferably amino-substituted compounds), the binder which is added affects both the mechanical characteristics, such as flexibility, film formation, etc., and also, to a certain extent, the electrophotographic characteristics, such as the photosensitivity, the residual charge and the behavior on cycling.

Film-forming compounds, such as polyester resins, polyvinyl chloride/polyvinyl acetate copolymers, styrene/maleic anhydride copolymers, polycarbonates, silicone resins, polyurethanes, epoxide resins, acrylates, polyvinyl acetals, polystyrenes, cellulose derivatives, such as cellulose acetobutyrates, etc., are employed as binders. In addition, subsequently crosslinkable binder systems, such as DD varnishes, polyisocyanate-crosslinkable acrylate resins, melamine resins, unsaturated polyester resins, etc., are successfully employed.

The use of cellulose nitrates, in particular of the highly viscous types, is particularly preferred owing to the combined advantages (high photosensitivity, flash sensitivity, high flexibility).

Conventional additives, such as leveling agents, e.g., silicone oils, wetting agents, in particular non-ionic substances, and plasticizers of various compositions, such as, for example, those based on chlorinated hydrocarbons or on phthalic acid esters, can also be added to the photoconductive systems. If appropriate, sensitizers and/or acceptors can also be introduced as an additive.

The following examples illustrate the invention in more detail.

EXAMPLE 1

A UV-hardenable protective layer is applied onto an electrophotographic recording material which comprises, according to the sequence of the layers, an electrically conductive support consisting of a 125 μm thick polyester film on which a 12 μm thick layer of aluminum has been laminated, a 0.2 μm thick dye layer applied onto this layer and comprising N,N'-dimethylperylimide (C.I. 71 130), as the charge carrier-producing layer, and an 8 μm thick charge-transporting layer of a mixture of 2,5-bis-(4'-diethylaminophenyl)-1,3,4-oxadiazole and cellulose nitrate of the standard type 7E according to DIN 53 179 in the weight ratio of 65:35.

For this purpose, a 75 μm thick polyester film support of very good planarity and transparency is homogeneously provided with a mixture of 50 parts by weight of an acrylated polyurethane (VPS 1748, Degussa) having a viscosity of 300 Pa.s at 25° C., a density of 1.15 g/cm$^3$ at 25° C., and an acid number of max. 0.1 mg KOH/g, as the reactive resin, 45 parts by weight of a pentaerithritol tri(tetra)-acrylate (PETA, Degussa) as the reactive diluent and 5 parts by weight of a mixture of substituted α-halogenoacetophenone and an epoxide-group-containing compound (Sandory ®1000, Sandoz AG) as the photoinitiator. The layer weight of the mixture is 1.6 g/m$^2$, corresponding to a thickness of about 1.6 μm. The coated film thus obtained is laminated on the layer side, in a laminating apparatus, onto the charge-transporting layer of the recording material, while heating the films to 50°–60° C. under gentle contact pressure from rollers.

The laminate is then cured on a rotating drum by means of a UV irradiation with a high pressure mercury vapor lamp (100 W/cm) at a distance of 25 cm over the course of 15 seconds. Thereafter, the polyester film serving as the support for the protective layer is partially peeled off, and the photosensitivity and the resistance to abrasion are measured with and without the protective layer, under identical conditions, which are described below.

Photosensitivity: To determine the discharge curves in light, the sample to be measured moves on a rotating plate, through a charging device, to an exposure station, where it is continuously exposed to a xenon lamp. A heat absorption glass and a neutral filter of 15% transparency are located in front of the xenon lamp. The light intensity in the plane of measurement is in the range of 40–60 μW/cm$^2$ measured with an optometer immediately after the decay curve in light has been determined. The charge level ($U_o$) and the photo-induced decay curve in light are recorded oscillographically through a transparent probe, via an electrometer. The photoconductor layer is characterized by the charge level ($U_o$) and that time ($T_{1/2}$) after which half the charge ($U_o/2$) is reached. The product of $T_{1/2}$ and the measured light intensity I (μW/cm$^2$) is the half-value energy $E_{1/2}$ (μJ/cm$^2$).

The residual charge ($U_R$) after 0.1 sec., determined from the above discharge curves in light, is a further measure of the discharge of the photoconductor layer.

Abrasion characteristics: The abrasion of the two materials is measured on a standard abrasion apparatus (Taber Abraser Type 352), under the following conditions:

| | |
|---|---|
| Abrasive agent (abrasive rollers) | CS-10 F Calibrese |
| Load | 250 g |
| Abrasion surface | 26.3 cm$^2$ |
| Number of cycles | 200 |

The abrasion in g/m$^2$ is the quotient of the gravimetrically determined abrasion in mg and the abrasion surface.

TABLE

| Recording Material | Protective layer thickness μm | (−)$U_o$/V | $U_R$/V after 0.1s | $E_{\frac{1}{2}}$μJ/cm$^2$ | Abrasion g/m$^2$ |
|---|---|---|---|---|---|
| 1 | — | 610 | 110 | 1.2 | 2.2–2.6 |

TABLE-continued

| Recording Material | Protective layer thickness μm | (−)$U_o$/V | $U_R$/V after 0.1s | $E_{\frac{1}{2}}$μJ/cm$^2$ | Abrasion g/m$^2$ |
|---|---|---|---|---|---|
| | 1.6 | 620 | 170 | 1.4 | 0.2 |
| 2 | — | 620 | 90 | 1.0 | 2.2–2.6 |
| | 1.6 | 620 | 170 | 1.3 | 0.2 |

The table also shows values for a recording material 2 which was produced and measured under the same conditions, as described, with the difference that N,N-di-(3-methoxypropyl)-perylimide was present as the dye.

EXAMPLE 2

A photoconductor system comprising a 100 μm thick aluminum foil as the support, a dye layer located thereon and containing N,N'-dimethylperylimide in a thickness corresponding to 0.2 g/m$^2$, and a charge-transporting layer composed of 50 parts by weight of 2,5-bis-(4'-diethylaminophenyl)-1,3,4-oxadiazole, 25 parts by weight of a polyester resin and 25 parts by weight of a polyvinyl chloride/polyvinyl acetate copolymer in a thickness corresponding to approximately 10 g/m$^2$ is coated with a UV-hardenable protective layer of 2 μm thickness. The protective layer, which consists of 80 parts by weight of a reactive resin, 15 parts by weight of a reactive diluent and 5 parts by weight of a photoinitatior, analogous to the preceding experiment, is first applied onto a planar polyethylene film, and the laminate thus obtained is laminated onto the photoconductive system. Curing is then effected with UV light under the conditions given in Example 1, and the polyethylene film is removed. The determination of photosensitivity and abrasion characteristics is carried out according to Example 1.

| Protective Layer | Thickness (μm) | (−)$U_o$/V | $U_R$/V after 0.1s | $E_{\frac{1}{2}}$μJ/cm$^2$ | Abrasion g/m$^2$ |
|---|---|---|---|---|---|
| no | — | 680 | 190 | 2.2 | 1.6 |
| yes | 2 | 690 | 280 | 3.45 | 0.01 |

EXAMPLE 3

A photoconductor layer of a thickness corresponding to approximately 7 g/m$^2$ and comprising 65 parts by weight of 2,5-bis-(4'-diethylaminophenyl)-1,3,4-oxadiazole and 35 parts by weight of cellulose nitrate of standard type 4E (DIN 53 179), in which 5 parts by weight of N,N'-dimethylperylimide are homogeneously dispersed, on a 100 μm thick aluminum support, is coated with UV-curable protective layer. The conditions for applying the protective layer having a thickness of 2–3 μm, its composition, and the determination of the photosensitivity and the abrasion are the same as those described in Example 1.

| Recording Material Protective Layer | (±)$U_o$/V | $E_{\frac{1}{2}}$ μJ/cm$^2$ | Abrasion g/m$^2$ |
|---|---|---|---|
| without | (−) 470 | 9.5 | 2.3 |
| without | (+) 590 | 8.8 | 2.3 |
| with | (−) 590 | 19.6 | not measurable |

-continued

| Recording Material Protective Layer | (±)$U_0$/V | $E_{\frac{1}{2}}$ μJ/cm² | Abrasion g/m² |
|---|---|---|---|
| with | (+) 730 | 13.5 | not measurable |

EXAMPLE 4

A photoconductive system produced analogously to Example 1 and containing the photoconductive layer and a protective layer of approximately 1 μm thickness on a 75 μm thick polyester film coated by vapor deposition with aluminum is tested in a dry toner coyping machine with regard to its surface properties and its photosensitivity. A magnetic brush unit containing a two-component toner mixture is used for developing, and the photoconductor surface is cleansed of residual toner by passing the layer past a rotating brush. It is found that, under the same copying conditions, the quality of the copies is the same with and without a protective layer. In a copying experiment of long duration, surface films are already visible on the photoconductor layer without a protective layer after 1,500 copies, and the surface has a more matt appearance, while, in contrast, no surface films at all are detectable on a photoconductor layer with a protective layer, and the surface is still glossy.

TABLE

| Number of Copies | (−)$U_0$/V | $U_R$V (in copying position) | Photo-conductor |
|---|---|---|---|
| 0 | 430 | 30 | Without |
| | 430 | 50 | With protective layer |
| 1,500 | 510 | 80 | Without |
| | 500 | 60 | With protective layer |

From these results, it can be seen that the residual charge in a material without a protective layer increases from 30 to 80 volts, while the slightly elevated residual charge in a material with a protective layer is virtually constant or has increased only slightly.

What is claimed is:

1. An electrophotographic recording material, consisting essentially of:

an electrically conductive support;

a photoconductive system coated on said conductive support and comprising at least one layer of organic material containing a charge carrier-producing compound and a charge-transporting compound;

an ultraviolet radiation-cured; transparent protective layer adjacent to said photoconductive system and comprising an acrylated binder; and a removable auxiliary support adjacent to the protective layer;

wherein the protective layer has been applied onto the surface of the photoconductive system by lamination together with the removable auxiliary support.

2. A recording material is claimed in claim 1, wherein the protective layer comprises an acrylated polyurethane, an acrylated polyester or an acrylated epoxide resin.

3. A recording material as claimed in claim 2, wherein the protective layer comprises an acrylated polyurethane.

4. A recording material as claimed in claim 3, wherein the acrylated polyurethane has, prior to curing, a viscosity of 300 Pa s at 25° C., a density of 1.15 g/cm³ at 25° C., and an acid number of max. 0.1 mg KOH/g.

5. A recording material as claimed in claim 1, wherein the acrylated binder of the protective layer is exposed to ultraviolet radiation in the presence of a reactive diluent during curing.

6. A recording material as claimed in claim 5, wherein the reactive diluent comprises trimethylol acrylate and/or pentaerythritol tri(tetra)acrylate.

7. A recording material as claimed in claim 1, wherein the acrylated binder of the protective layer is exposed to ultraviolet radiation in the presence of a photoinitiator during curing.

8. A recording material as claimed in claim 7, wherein the photoinitiator comprises a substituted α-halogenoacetophenone or benzil dimethyl ketal as the photoinitiator.

9. A recording material as claimed in claim 1, wherein the protective layer comprises from about 40–80 parts by weight of an acrylated polyurethane, from about 15–50 parts by weight of trimethylol acrylate and from about 1–5 parts by weight of a photoinitiator.

10. A recording material as claimed in claim 1, wherein the protective layer is from 0.1 to 10 μm thick.

11. A recording material as claimed in claim 1, further comprising an insulating interlayer located adjacent to said conductive support.

* * * * *